United States Patent [19]

Storfossen

[11] 4,178,784

[45] Dec. 18, 1979

[54] METHOD FOR REMOVING PLATING RESIDUES FROM A PLATED WIRE

[75] Inventor: Asbjörn Storfossen, Drammen, Norway

[73] Assignee: Kabmatik AB, Vallingby, Sweden

[21] Appl. No.: 902,087

[22] Filed: May 2, 1978

[30] Foreign Application Priority Data

May 6, 1977 [NO] Norway ..... 771613

[51] Int. Cl.[2] ..... B21C 23/24; B21C 43/02; C25D 7/06

[52] U.S. Cl. ..... 72/47; 204/28; 204/209

[58] Field of Search ..... 29/527.2; 72/39, 41, 72/45, 46, 47; 134/10, 13, 16; 204/28, 206, 207, 209

[56] References Cited

U.S. PATENT DOCUMENTS

| | | | |
|---|---|---|---|
| 2,196,002 | 4/1940 | Whitney et al. | 204/28 |
| 2,317,350 | 4/1943 | Adler et al. | 204/28 |
| 2,370,973 | 3/1945 | Lang | 204/209 |
| 2,445,675 | 7/1948 | Lang | 204/209 |
| 3,957,452 | 5/1976 | Schaer et al. | 204/206 |

FOREIGN PATENT DOCUMENTS

| | | | |
|---|---|---|---|
| 431027 | 6/1935 | United Kingdom | 72/44 |

*Primary Examiner*—E. M. Combs
*Attorney, Agent, or Firm*—Hane, Roberts, Spiecens & Cohen

[57] ABSTRACT

In a method of continuously plating wire electrolytically, acid crystal and liquid residues originating from the plating bath form on the wire. In order to remove these residues from the surface of the wire, the method of the invention comprises mechanically treating the surface of the wire while supplying a liquid to the wire prior to the mechanical treatment. The wire undergoes treating in the presence of the supplied liquid and the composition of the liquid and residues in such that the residues are not dissolved or emulgated in the liquid. The liquid with the residues can be collected and the residues separated from the liquid so that the liquid can be recycled back to the stage of mechanical treatment of the wire in a closed circuit.

7 Claims, 1 Drawing Figure

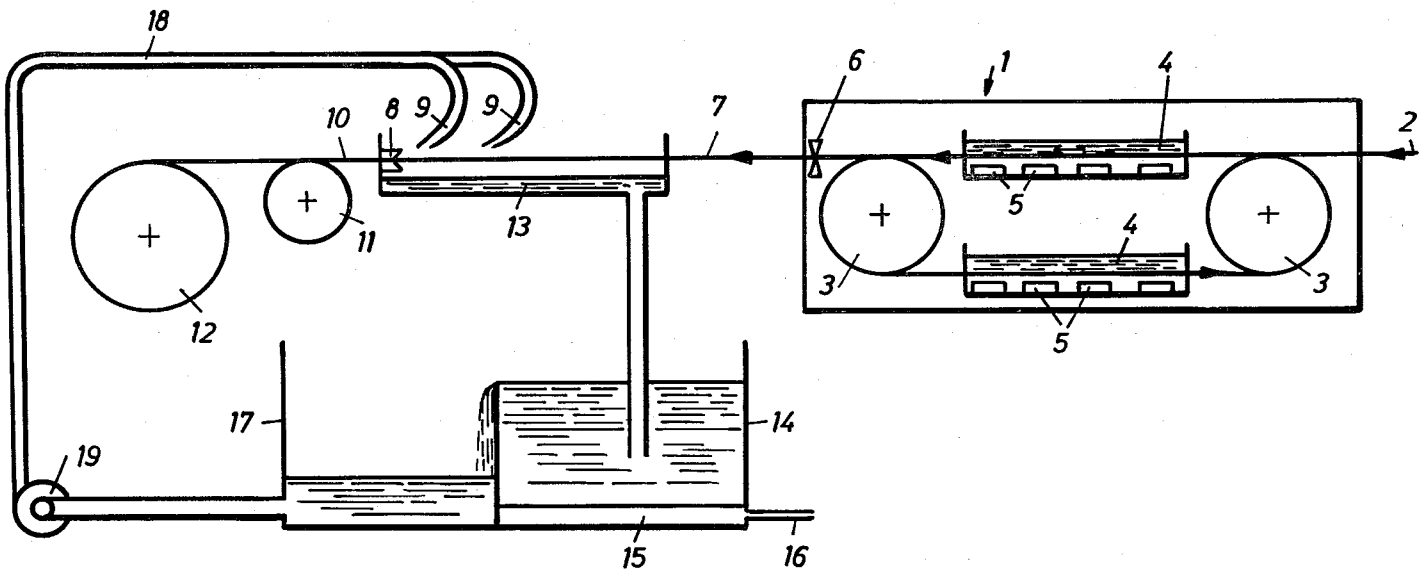
1
2
3
4
5
6
7
8
9
10
11
12
13
14
15
16
17
18
19

METHOD FOR REMOVING PLATING RESIDUES FROM A PLATED WIRE

FIELD OF THE INVENTION

The present invention relates to a method for removing plating residues, for example, acid crystals and liquid originating from the plating bath during electrolytic wire plating.

BACKGROUND

During continuous electrolytic metal wire plating, residues of the electrolyte remain on the wire partly as crystals, partly as liquid. These residues must be removed before further treatment of the wire. Usually the wire is rinsed with water which dissolves the crystals. The dissolved crystals make the water acid and the rinsing water must therefore be purified before it may be discharged which raises the investment costs as well as the working costs of the plating equipment considerably.

SUMMARY OF THE INVENTION

An object of the present invention is to provide a process for removing plating residues which makes it possible to avoid the need for a purification plant without loading the discharge outlet with acid water. Besides being environmentally sound and cheap the process according to the invention involves advantages as regards the further treatment of the wire. The process according to the invention is characterized in that the wire surface is mechanically processed during supply of a liquid in which the plating residues are transported away without being dissolved or emulgated with the transporting liquid, after which the plating residues are separated from the transporting liquid. After the separation of the plating residues, the transporting liquid is recycled to the process step in which the wire surface is mechanically processed in order to be reutilized. Thus, it will be possible to run the process in a closed system with recycling of the transporting liquid and in that way the need for a discharge outlet will be eliminated.

The transporting liquid may be an oil. Not any oil may be used, since, as mentioned, possible remaining liquid from the plating bath is not allowed to emulgate with the oil and the acid crystals are not allowed to be dissolved in the oil causing the oil to be acid. Furthermore, the oil must be of that character that it can easily be separated from the plating residues. Such oils are well known. One example of such an oil, which is well suitable to be used in the process according to the invention, is an oil which is sold under the commercial name "Almag" by TEXACO OIL and which is a thinly fluid, pure mineral oil which among other things is used a cooling liquid during machining of aluminum and magnesium.

The mechanical treatment may consist of the wire being drawn through a die. In such case, the oil, in addition to the above mentioned properties, also should serve as a lubricant in the drawing process. The above mentioned oil which is sold under the trade name "Almag" is also well penetrating, i.e. it has a tendency to wet metals and creep along their surfaces at the same time as it creeps between the metal surface and possible liquid layer and impurities. The oil, in other words, releases the plating residues from the wire surface so that these allow themselves to be completely removed by the following mechanical treatment of the wire surface.

The mechanical treatment in the die is preferabley performed so that a cross section reduction of 5 to 20% is obtained.

The plating residues may be removed from the transporting liquid according to any suitable method, for example by filtering, centrifugating or sedimentation. The latter is the most simple of these separation methods and it is promoted by the fact that the preferably used oil is thinly fluid. With the proposed oil it is possible to obtain a good sedimentation of the acid crystals within 10 minutes.

Usually, only small amounts of transporting liquid are needed and together with the short sedimentation time, the sediment container for the acid crystals may be relatively small and only a small pump is needed for the recycling of the transporting liquid. The equipment needed for the cleaning of a plated wire according to the present invention is thus very simple and cheap.

BRIEF DESCRIPTION OF THE DRAWING

The process according to the invention will be further described with reference to the attached drawing, the sole FIGURE of which schematically illustrates a plating plant for electrolytic plating of metal wire which plant is equipped with a subsequent purification plant operating in accordance with the process according to the invention.

DETAILED DESCRIPTION

The drawing shows a simplified plating plant, which is designated 1. A metal wire 2 is introduced into the plating plant and passes many times over rolls or wheels 3 and passes through two electrolyte baths 4 which contain anodes 5 of the plating metal. The electrolyte baths 4 can, for example, contain the fluoborate of the plating metal and bath additives. It should not be necessary to further describe various formulas of the electrolyte bath, as this is not part of the present invention. The complete plating plant 1 is known and operates completely in a known manner. Thus, the rolls or wheels 3 are current contact wheels causing the wire 2 to be the cathode in the electrolyte baths. Furthermore, there is blowoff equipment 6 arranged at the wire outlet of the plating plant, which, to the highest possible degree, blows the bath residues off the wire 2 and brings them back to the baths. Through partial evaporation of water, residues of the electrolyte in the form of crystals will remain on the wire surface at the same time as it is impossible always to avoid remaining liquid on the wire. These bath residues are removed in the subsequent cleaning plant by drawing the plated wire 7 through a die 8 at the same time as a suitable oil is deposited on the wire 7 through nozzles 9. The cleaned wire 10 is drawn by means of a cable puller 11 and taken up on a roll 12, which may be transported to further machining stations for the wire. Alternatively, the wire itself may be passed on directly to these machining stations without being taken up on intermediate rolls.

That oil which is deposited on the wire and removed in the die 8 is collected together with the electrolyte residues in a container 13 and transported to a settling tank 14. Settled sludge 15 in tank 14 contains among other things, salt residues in crystallinic form and metal residues which are collected at the bottom of the tank 14 and drained off as indicated at 16. Pure oil is passed by way of over flow to another tank 17, from which the oil is transported back to the nozzles 9 through a pipe 18 by means of a pump 19. In the nozzles 9, a valve or the like may be arranged for the control of the oil flow. Besides serving as a transportation medium for the transportation of the plating residues being mechanically taken away, the oil serves as a lubricant for the die 8.

With the process according to the invention, a number of advantages are obtained in comparison with the conventional rinsing of the wire with pure water. For one thing, the wire cleaning system is a closed system with recycling of the transporting oil. Thus, no cleaning plant for the rinsing water is needed and no liquid is discharged in the exhaust system. It is fully possible to separate fluoborate or other crystals from the settled sludge, if it would be desirable to recover valuable materials which are to be found in this sludge. Further, it is not difficult to clean the wire also at high wire speeds. At rinsing the wire with pure water, however, the cleaning deteriorates with increasing speed. A further advantage of the process according to the invention is that the resulting wire becomes bright an homogeneous, and at the same time less metal sludge appears in the wire drawing machine in the following wire drawing operation.

Experiments on cleaning of electrolytically tin plated wire with dimensions from 1.40–2.6 mm in diameter have been carried out. A total of 15 metric tons of wire have been treated in compliance with the process according to the invention. The result has been very good and the quantity of plating residues on the wire have, in careful chemical analyses, shown to be considerably less than the corresponding quantity on a wire rinsed in water in a conventional manner.

We claim:

1. In a method of continuously electrolytically plating wire, an improvement for removing from the surface of the wire acid crystal and liquid residues originating from the plating bath, the improvement including the steps of: mechanically treating the surface of the wire to remove residue thereon, and supplying a non-aqueous liquid to the wire prior to said mechanical treating so that the wire undergoes such treating in the presence of the supplied liquid, the composition of the liquid and residues being such that said residues are not dissolved or emulgated in the liquid.

2. The method as claimed in claim 1 further comprising collecting the liquid with the residues thereon after the mechanical treating of the wire, separating said residues from said liquid and recycling the liquid back to the stage of mechanical treating of the wire.

3. The method as claimed in claim 2 wherein said liquid is continuously recyled in a closed circuit.

4. The method as claimed in claim 8 wherein said residues are separated from said liquid by sedimentation.

5. The method as claimed in claim 1 wherein said liquid is an oil.

6. The method as claimed in claim 1 wherein said mechanical treating step comprises drawing the wire through a die.

7. The method as claimed in claim 6 wherein the wire is drawn through the die with a cross-section reduction of 5–20%.

* * * * *